US005274993A

United States Patent [19]

Keller

[11] Patent Number: 5,274,993

[45] Date of Patent: Jan. 4, 1994

[54] COMBUSTION CHAMBER OF A GAS TURBINE INCLUDING PILOT BURNERS HAVING PRECOMBUSTION CHAMBERS

[75] Inventor: Jakob Keller, Dottikon, Switzerland

[73] Assignee: Asea Brown Boveri Ltd., Baden, Switzerland

[21] Appl. No.: 775,603

[22] Filed: Oct. 15, 1991

[30] Foreign Application Priority Data

Oct. 17, 1990 [EP] European Pat. Off. ..... 90119900.0

[51] Int. Cl.[5] ..... F23R 3/30

[52] U.S. Cl. ..... 60/39.37; 60/737

[58] Field of Search ..... 60/737, 738, 748, 39.37, 60/734, 736.1; 431/202, 268

[56] References Cited

U.S. PATENT DOCUMENTS 4,194,358 3/1982 Stenger ..... 60/747
4,781,030 11/1988 Hellat et al. ..... 60/743
5,081,844 1/1992 Keller et al. ..... 60/39.37

FOREIGN PATENT DOCUMENTS 0210462 2/1987 European Pat. Off. .
0387532 9/1990 European Pat. Off. .
0401529 12/1990 European Pat. Off. .

*Primary Examiner*—Richard A. Bertsch
*Assistant Examiner*—Timothy S. Thorpe
*Attorney, Agent, or Firm*—Burns, Doane, Swecker & Mathis

[57] ABSTRACT

A series of premix burners of different sizes are arranged at the inlet flow end of a combustion chamber, preferably of the form of an annular combustion chamber. The large premix burners, which are the main burners of the combustion chamber, and the small premix burners, which are the pilot burners of the combustion chamber, emerge into a front wall of the combustion chamber, these premix burners being arranged alternately relative to one another and at a constant distance apart. The main burners emerge directly into the front wall to the combustion space and the pilot burners have, downstream of their burner length, a precombustion chamber extending as far as the front wall. Both the evaporation of a liquid fuel and the burn-out of liquid or gaseous fuels in the low part-load range of the machine can be decisively improved in this precombustion chamber.

6 Claims, 4 Drawing Sheets

FIG. 1
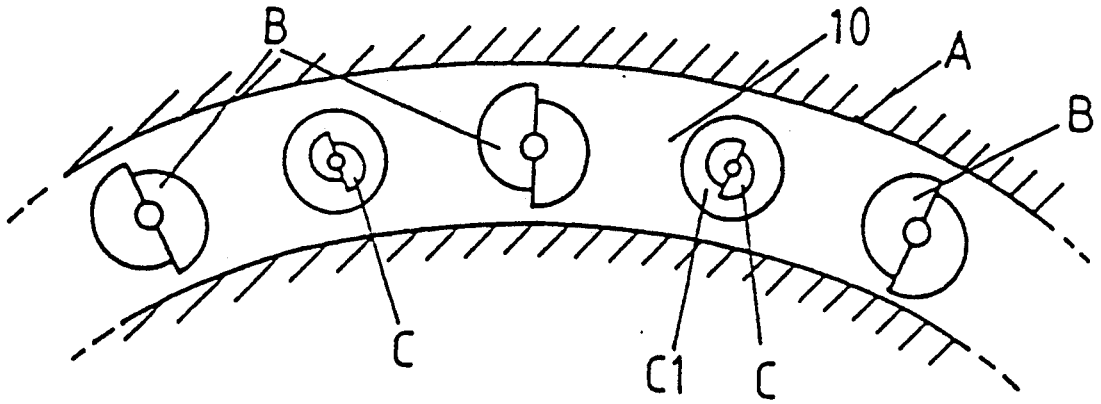
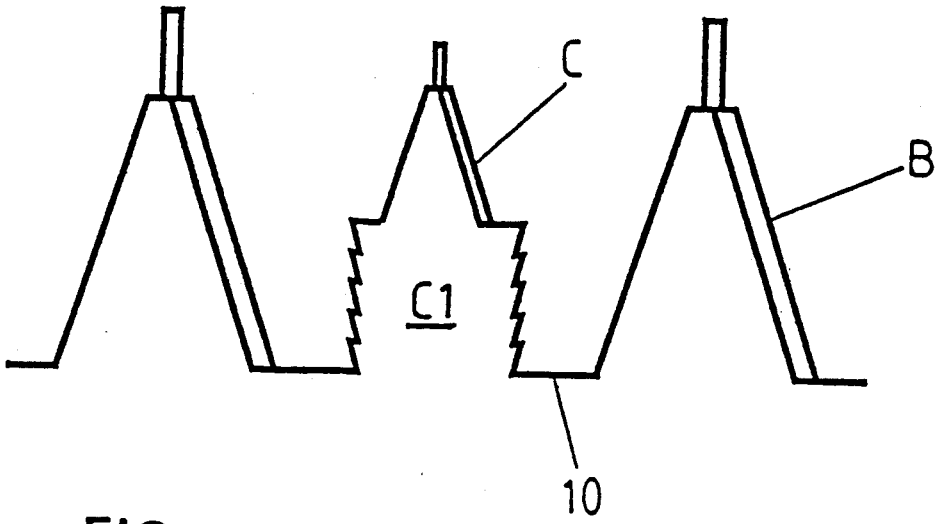
FIG. 2

COMBUSTION CHAMBER OF A GAS TURBINE INCLUDING PILOT BURNERS HAVING PRECOMBUSTION CHAMBERS

BACKGROUND OF THE INVENTION

1. Field of the Invention

The present invention concerns a combustion chamber for a gas turbine in accordance with the preamble to claim 1.

2. Discussion of Background

Because of the extremely low $NO_x$, CO and UHC emissions specified for the operation of a gas turbine, many manufacturers are starting to use premix burners. One of the disadvantages of premix burners is that they go out at very low excess air numbers, at a λ of about 2, depending on the temperature downstream of the compressor of the gas turbine group. On the other hand, the "lean premix combustion" leads to poor combustion efficiency in the lower load range of a combustion chamber and to correspondingly high $NO_x$, CO and UHC emissions. Particularly in the case of multi-shaft machines, this problem becomes critical because the combustion chamber pressure at idle is then typically very low. For this reason, the air temperature after the compressor is also low. In the case of oil combustion, the situation then becomes particularly difficult where the air temperature is less than the boiling temperatures of a major proportion of the fuel fractions. A suggested way of dealing with this problem consists in supporting the premix burner by one or several pilot burners in the part-load range. Diffusion burners are usually employed for this purpose. Although this technique permits very low $NO_x$ emissions in the full-load range, this supporting burner system leads to substantially higher $NO_x$ emissions during part-load operation. The variously reported attempts to operate the supporting diffusion burners with a leaner mixture or to use smaller supporting burners must fail because the burn-out becomes worse and the CO and UHC emissions are increased greatly. Among specialists, this condition has become known as the CO/UHC-$NO_x$ dilemma.

SUMMARY OF THE INVENTION

Accordingly, one object of this invention, as described in the claims, is to maximize the efficiency at part-load operation in a combustion chamber of the type mentioned at the beginning and to minimize the various pollutant emissions.

For this purpose, a pilot burner designed on the basis of the premix burner is provided in each case between two main burners also designed on the basis of the premix burner, the pilot burner being combined with a precombustion chamber. In terms of the combustion air flowing through them, the main burners have a size ratio to the pilot burners which is determined from case to case. In the lower part-load range, only the pilot burners (single-stage or multi-stage) are supplied with fuel. The pilot burner/precombustion chamber combination is then operated in "rich primary mode". In this way, it is possible, by means of the fuel-rich combustion in the precombustion chamber, to improve decisively both the evaporation of the liquid fuel and the burn-out of the liquid or gaseous fuel. At a sufficiently high load, as soon as the combustion chamber pressure is high enough, the main burner system is then switched on and the pilot burners are then operated in the "lean primary mode".

An advantageous embodiment of the invention is obtained if the main burners and the pilot burners consist of differently sized, so-called double-cone burners and if these burners are integrated into an annular combustion chamber.

Advantageous and desirable further extensions of the arrangement according to the invention are described in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a diagrammatic view onto a part of the front wall of an annular combustion chamber with a similarly diagrammatic view of the main and pilot burners located there, FIG. 2 is a diagrammatic axial section through a sector of the annular combustion chamber in the burner plane.

DESCRIPTION OF THE PREFERRED EMBODIMENTS

Figure 3:
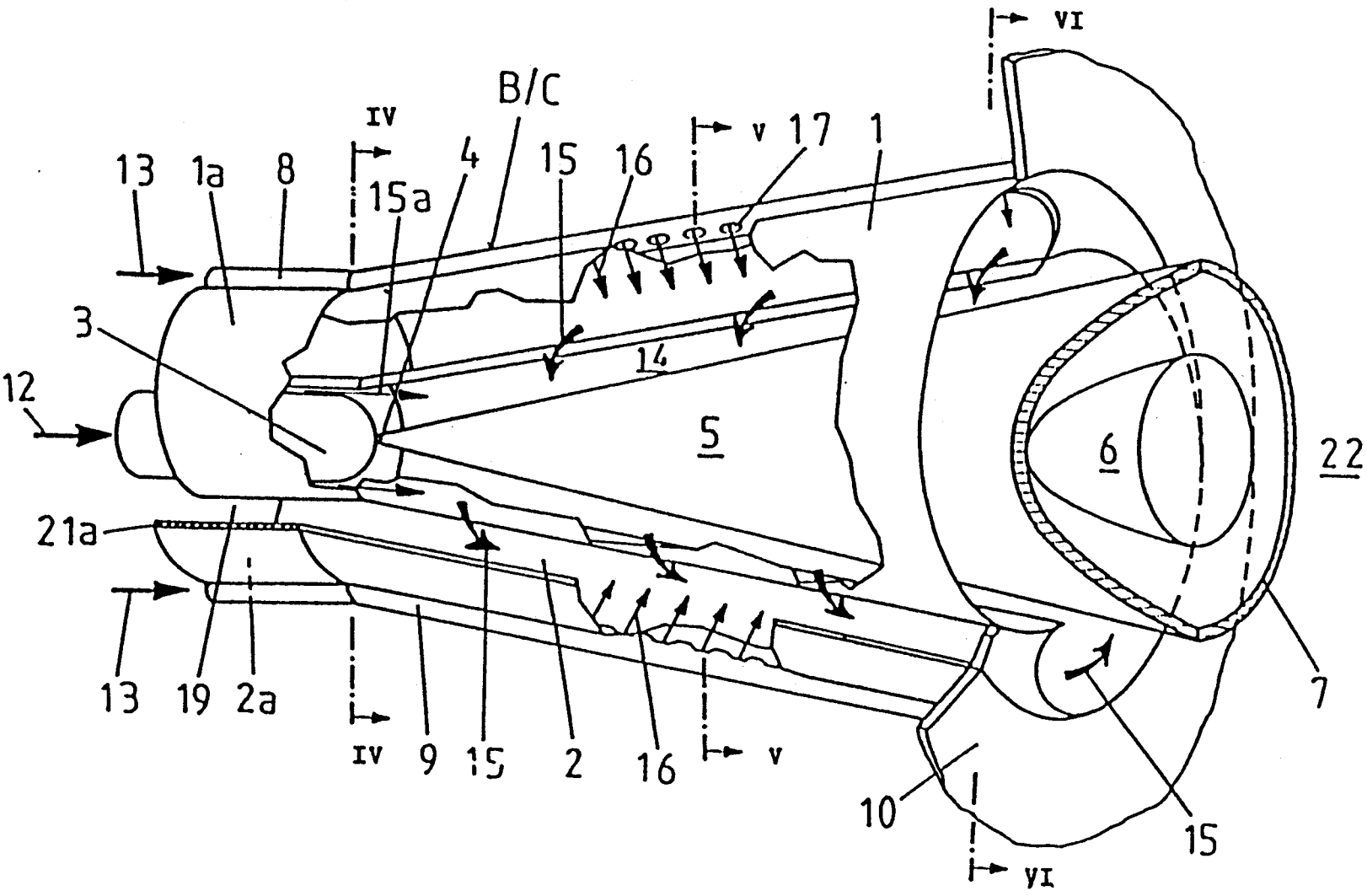
FIG. 3 is a burner in the form of a double-cone burner, which is both main burner and pilot burner, in perspective view and appropriately sectioned.

Referring now to the drawings, wherein like reference numerals and letters designate identical or corresponding parts throughout the several views, where all elements not necessary for immediate understanding of the invention are omitted and the direction of flow of the media is indicated by arrows, FIG. 1 shows a detail of a sector of an annular combustion chamber A along the front wall 10 of the same. The location of the individual main burners B and pilot burners C is obvious from this figure. These burners are located equally spaced and alternately along the front wall 10 on a common circle. The difference in size shown between the main burners B and the pilot burners C is only of a qualitative nature. The effective size of the individual burners B and C and their distance from one another depends mainly on the size and output of the particular combustion chamber. In an annular combustion chamber of medium size, the size ratio between the pilot burners C and the main burners B is selected in such a way that approximately 23% of the combustion air flows through the pilot burners C and approximately 77% through the main burners B. The figure also shows that the pilot burners C are each supplemented by a precombustion chamber C1 whose design is explained in more detail in FIG. 2.

FIG. 2 is a diagrammatic axial section through the annular combustion chamber in the plane of the burners B and the C. As can be seen in FIG. 2, outlets of the main burners B and the pilot burners C all emerge through the wall at the same height, that is, the outlets are uniform, or even, with the front wall 10 of the following combustion space of the combustion chamber—the main burner B directly by means of its outlet opening but the pilot burner C by means of an outlet of the precombustion chamber C1 located downstream of the burner part. The diagrammatic view of FIG. 2 alone is sufficient to show that the main burners B and the pilot burners C are both designed as premix burners, i.e. they do not require the otherwise usual premixing zone. In such a design, it is of course necessary to ensure that flash-back into the premix zone of the particular burner, upstream of the front wall 10, is excluded. A burner which can satisfy this condition will be described in more detail in FIGS. 3–6. The size ratio between the main burners B and the pilot burners C, relative to one another, also indicates to a certain degree the operating method with respect to the load range. In the lower part-load range, only the pilot burners C (single-stage or multi-stage) are supplied with fuel in such a configuration. The "lean premix combustion" leads to a poor combustion efficiency in the low load range of a combustion chamber and to correspondingly high $NO_x$, CO and HC emissions. Where multi-shaft machines are used, for example, this problem becomes particularly critical because the combustion chamber pressure is typically very low at idle. For this reason, the air temperature after the compressor is also very low with the result that the premixing of this compressor air with the fuel used is not optimum. In the case of oil combustion, the situation is particularly difficult because this particular air temperature is less than the boiling temperatures of a major proportion of the fractions of the fuel just mentioned. The poor part-load efficiency and the high pollutant emissions is improved by combining the pilot burners C with the various precombustion chambers C1 already mentioned. On the basis of the fact that only the pilot burners C are operated in the lower part-load range, i.e. are supplied with fuel, it is possible—by means of the precombustion chamber C1 which is located downstream of the maximum outlet opening of the pilot burner C and directly upstream of the combustion space of the annular combustion chamber—to operate a fuel-rich precombustion. In this precombustion chamber C1, both the evaporation of the liquid fuel and the burn-out of liquid or gaseous fuels can be decisively improved. At a sufficiently high load, as soon as the combustion chamber pressure is high enough, the main burner system is then switched on. The pilot burners C are then operated in the "lean primary mode". This system can also be employed directly with advantage in single-shaft machines, particularly where the idling temperature of the air is not at least 300°.

Figure 4:
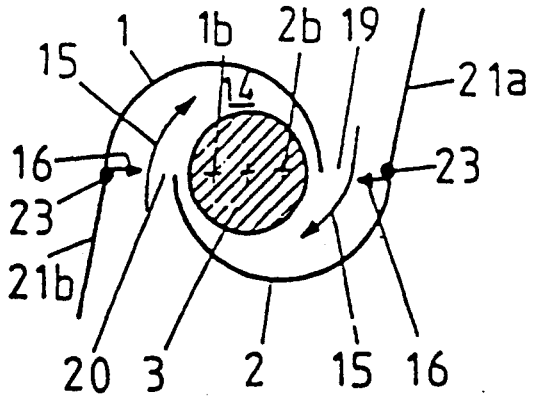
FIGS. 4, 5 and 6 are corresponding sections through the planes IV—IV (=FIG. 4), V—V (=FIG. 5) and VI—VI (=FIG. 6), these sections being only a diagrammatic, simplified view of the double-cone burner of FIG. 3.
Figure 5:
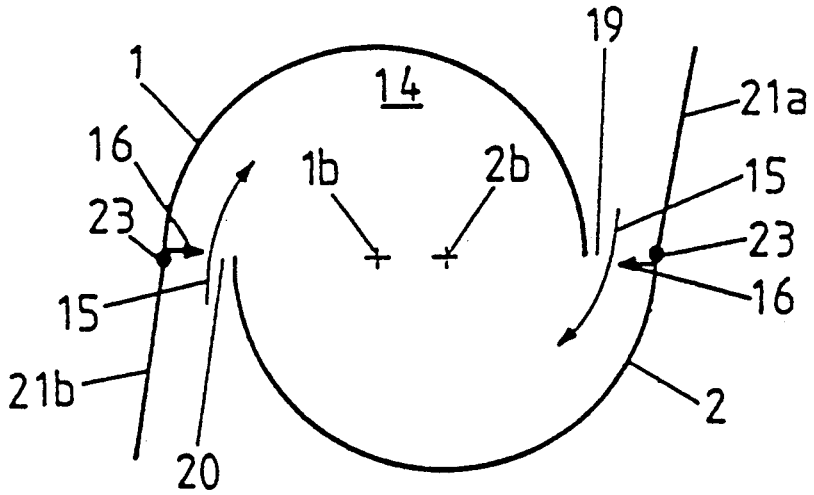
Figure 6:
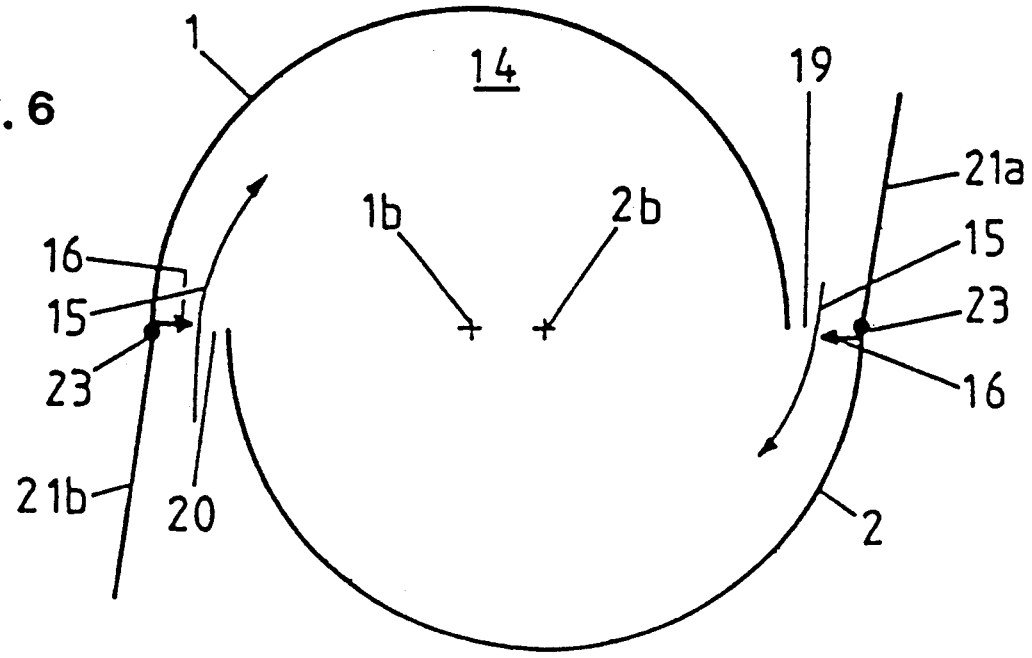

In order to understand the construction of the burners B and C better, it is advantageous to consider as FIG. 3, the individual sections according to FIGS. 4 to 6. Furthermore, in order to avoid making FIG. 3 unnecessarily difficult to understand the guide plates 21*a*, 21*b* (shown diagrammatically in FIGS. 4–6) are only indicated therein. In the following, reference is made to FIGS. 4–6 as required, in the description of FIG. 3.

Figure 7:
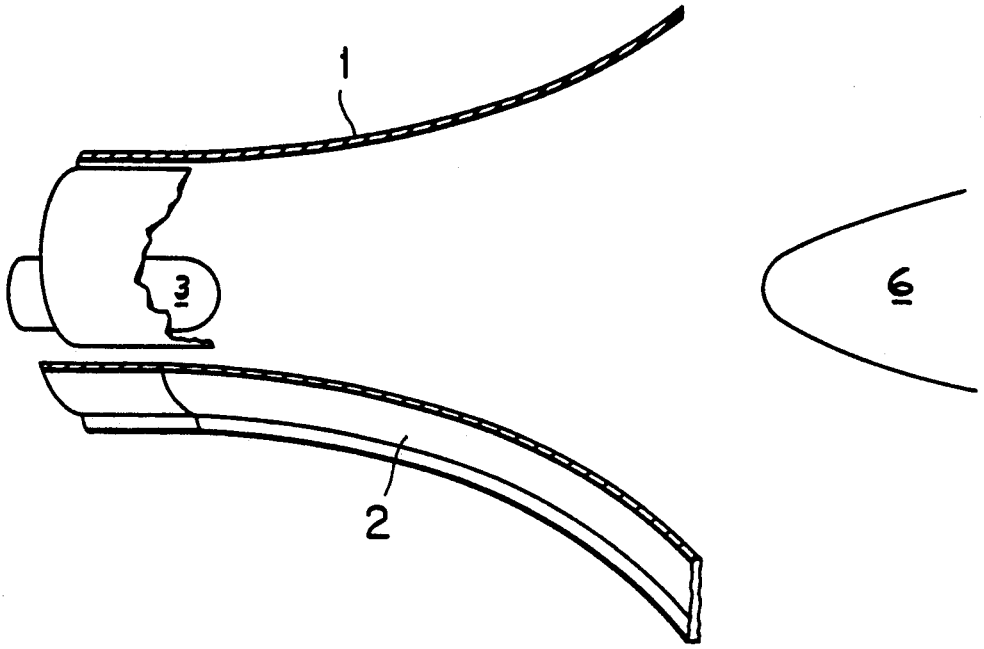
FIG. 7 is a profile view of an alternate embodiment of the form of the double-cone burner in section.
Figure 8:
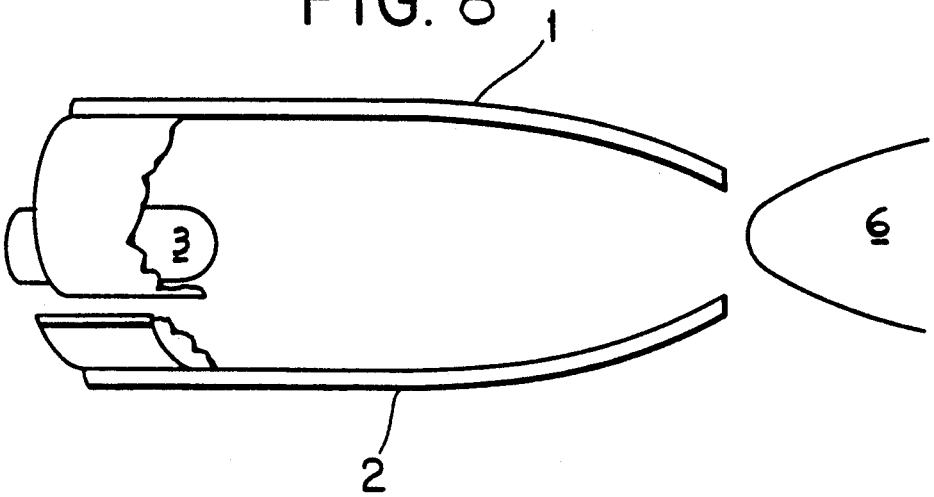
FIG. 8 is a profile view of a further alternative embodiment of the form of the double-cone burner in section.

The burner of FIG. 3, which in terms of its design, can be either main burner B or pilot burner C, consists of two half hollow part-conical bodies 1, 2 which are offset radially relative to one another with respect to their longitudinal axes of symmetry. The offset of the particular axes of symmetry 1*b*, 2*b* relative to one another produces a tangential air inlet slot 19, 20 on opposite sides of the part-conical bodies 1, 2 as an opposed inlet flow arrangement (on this point, see FIGS. 4–6), through which slots the combustion air 15 flows into the internal space of the burner, i.e. into the conical hollow space 14 formed by the two part-conical bodies 1, 2. The conical shape of the part-conical bodies 1, 2 shown has a certain fixed angle in the flow direction. The part-conical bodies 1, 2 can, of course, have a progressive or degressive conical inclination in the flow direction. FIG. 7 is a side view of the part-conical bodies 1, 2 having a progressive conical inclination, which in profile appear concave in the direction flow. Similarly, FIG. 8 is a side view of the part-conical bodies having a degressive conical inclination, which in profile appear convex in the flow direction are not included in the drawing because they can be directly understood. The shape which is finally given preference depends mainly on the particular combustion parameters specified in each case. Each of the two part-conical bodies 1, 2 has a cylindrical initial part 1*a*, 2*a* and these, by analogy with the part-conical bodies 1, 2, extend off-set relative to one another so that the tangential air inlet slots 19, 20 are continuously present over the whole of the burner. A nozzle 3, whose fuel injection 4 coincides with the narrowest cross-section of the conical hollow space 14 formed by the two part-conical bodies 1, 2, is located in this cylindrical initial part 1*a*, 2*a*. The size of this nozzle 3 depends on the type of burner, i.e. on whether a pilot burner C or a main burner B is involved. The burner can, of course, be designed to be purely conical, i.e. without cylindrical initial parts 1*a*, 2*a*. The two part-conical bodies 1, 2 each have a fuel pipe 8, 9, provided with openings 17 through which fuel pipes 8, 9 is fed a gaseous fuel 13 which is in turn mixed with the combustion air 15 flowing into the conical hollow space 14 through the tangential air inlet slots 19, 20. The fuel pipes 8, 9 are preferably provided at the end of the tangential inlet flow, directly before entry into the conical hollow space 14, this being done in order to achieve optimum velocity-conditioned mixing 16 between the fuel 13 and the combustion air 15 flowing in. Mixed operation with both fuels 12, 13 is of course possible. At the combustion space end 22, the outlet openings of the burner B/C merge into a front wall 10 in which holes (not, however, shown in the drawing) can be provided in order to supply dilution air or cooling air, when needed; to the front part of the combustion space. The liquid fuel 12, preferably flowing through the nozzle 3, is sprayed in at an acute angle into the conical hollow body 14 in such a way that the most homogeneous possible conical spray pattern occurs in the burner outlet plane. This is only possible if the inner walls of the part-conical bodies 1, 2 are not wetted by the fuel injection 4, which can involve air-supported or pressure atomization. For this purpose, the conical liquid fuel profile 5 is enclosed by the tangentially entering combustion air 15 and a further axially supplied combustion air flow 15*a*. The concentration of the liquid fuel 12 is continuously reduced in the axial direction by the mixed-in combustion air 15. If gaseous fuel 13 is injected via the fuel pipes 8, 9, the formation of mixture with the combustion air 15 then occurs, as has already been briefly explained above, in the immediate region of the air inlet slots 19, 20 at the inlet into the conical hollow body 14. In association with the injection of the liquid fuel 12, optimum homogeneous fuel concentration over the cross-section is achieved in the region of the vortex collapse, i.e. in the region of the reverse flow zone 6. Ignition occurs at the apex of the reverse flow zone 6. It is only at this point that a stable flame front 7 can occur. Flash-back of the flame into the burners B, C, as was always potentially the case with known premix sections (for which attempts are made to provide a solution by complicated flame holders), does not have to feared in this case. If the combustion air is preheated, accelerated complete evaporation of the liquid fuel 12 occurs before the point is reached at the outlet of the burners B, C at which ignition of the mixture can occur. The degree of evaporation obviously depends on the size of the burners B, C, on the droplet size of the fuel injected and on the temperature of the combustion air flows 15, 15*a*. Minimized pollutant emission values occur when complete evaporation can be provided before entry into the combustion zone. The same also applies for near-stoichiometric operation when the excess air is replaced by recirculating exhaust gas. Narrow limits have to be maintained in the design of the part-conical bodies, 1, 2 with respect to cone angle and the width of the tangential air inlet slots 19, 20 so that the desired airflow field, with its reverse flow zone 6 for flame stabilization, occurs in the region of the burner outlet. In general, it may be stated that a reduction of the air inlet slots 19, 20 displaces the reverse flow zone 6 further upstream, although the mixture would then ignite earlier. It should, however, be stated at this point that the reverse flow zone 6, once fixed, is positionally stable per se because the swirl increases in the flow direction in the region of the conical shape of the burner. The axial velocity can also be affected by the axial supply of combustion air 15*a*. The design of the burner is extremely suitable for changing the size of the tangential air inlet slots 19, 20, for a specified installation length of the burner, in that the part-conical bodies, 1, 2 can be displaced towards one another or away from one another so that the distance between the two central axes, 1*b*, 2*b* can be reduced or increased so that, correspondingly, the gap size of the tangential air inlet slots 19, 20 also changes, as can be seen particularly well from FIGS. 4–6. The part-conical bodies 1, 2 can, of course, also be displaced relative to one another in another plane so that they can even be arranged to overlap. It is even possible to displace the part-conical bodies 1, 2 within one another in a spiral by means of opposing rotary motion or to displace the part-conical bodies 1, 2 towards one another by an axial displacement. It is therefore possible to vary the shape and size of the tangential air inlet slots 19, 20 as desired so that the burner B, C can be individually matched within a certain operational band width without changing its installation length.

The geometrical configuration of the guide plates 21*a*, 21*b* can be seen from FIGS. 4–6. They have flow guidance functions in that, depending on their length, they lengthen the relevant end of the part-conical bodies 1, 2 in the incident flow direction of the combustion air 15. The guidance of the combustion air 15 into the conical hollow space 14 can be optimized by opening or closing the guide plates 21*a*, 21*b* around a center of rotation 23 located in the region of the inlet into the conical hollow space 14, this being particularly necessary when the original gap size of the tangential air inlet slot 19, 20 is changed. The burners B and C can also, of course, be operated without guide plates or, alternatively, other auxiliary means can be provided for this purpose.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. A combustion chamber of a gas turbine, comprising:

an annular combustion chamber having an inlet flow end;

an annular front wall formed at the inlet flow end;

a plurality of main premix burners arranged in the annular front wall having outlet openings at the annular front wall;

a plurality of pilot premix burners, each having a precombustion chamber extending from an outlet opening, the pilot premix burners and precombustion chambers arranged in the annular front wall adjacent to and alternating with the main premix burners, with outlets of the precombustion chambers at the annular front wall;

wherein the premix burners have, in the flow direction, at least two hollow, conical partial bodies positioned one upon the other, the longitudinal axes of symmetry of which extend offset radially relative to one another, wherein the longitudinal axes of symmetry extending offset produce oppositely flowing tangential inlet slots for a combustion air flow wherein at least one fuel nozzle is located in the conical hollow space formed by the conical partial bodies, the injection of the fuel from this fuel nozzle being located centrally relative to the longitudinal axes of symmetry, extending offset relative to one another, of the conical partial bodies.

2. The combustion chamber as claimed in claim 1, wherein further nozzles for a further fuel are present in the region of the tangential inlet slots.

3. The combustion chamber as claimed in claim 1, wherein the partial bodies widen conically at a fixed angle in the flow direction.

4. The combustion chamber as claimed in claim 1, wherein the partial bodies have a progressive conical inclination in the flow direction.

5. The combustion chamber as claimed in claim 1, wherein the partial bodies have a degressive conical inclination in the flow direction.

6. A method for operating a premix burner as claimed in claim 1, wherein the fuel injection forms, in the conical hollow space of the premix burner, a conically spreading fuel column which does not wet the inner walls of the conical hollow space and which is enclosed by a combustion air flow flowing tangentially into the conical hollow space via the inlet slots and by an axially supplied combustion air flow, wherein the ignition of the mixture of combustion air and fuel takes place at the outlet of the premix burner, stabilization of the flame front taking place in the region of the burner outlet by means of a reverse flow zone.

* * * * *